US009062668B2

(12) United States Patent
Wang et al.

(10) Patent No.: US 9,062,668 B2
(45) Date of Patent: Jun. 23, 2015

(54) SUPPLEMENTAL AIR PRESSURE PROVIDING DEVICE ADAPTED FOR USE WITH AN INFLATING MODULE FOR INFLATING AN INFLATABLE OBJECT

(75) Inventors: Cheng-Chung Wang, Taipei (TW); Chien-Hua Wang, Taipei (TW)

(73) Assignee: Team Worldwide Corporation, Taipei (TW)

( * ) Notice: Subject to any disclaimer, the term of this patent is extended or adjusted under 35 U.S.C. 154(b) by 997 days.

(21) Appl. No.: 13/094,556

(22) Filed: Apr. 26, 2011

(65) Prior Publication Data

US 2011/0259449 A1 Oct. 27, 2011

(30) Foreign Application Priority Data

Apr. 26, 2010 (CN) ..... 2010 1 0161736

(51) Int. Cl.

| | |
|---|---|
| ***F04B 39/00*** | (2006.01) |
| ***F04B 35/04*** | (2006.01) |
| *F04B 35/06* | (2006.01) |

(52) U.S. Cl.

CPC ..... *F04B 35/045* (2013.01); *F04B 35/06* (2013.01); *F04B 39/0027* (2013.01); *F04B 39/0033* (2013.01)

(58) Field of Classification Search

CPC ..... F04B 43/04; F04B 45/02; F04B 45/022; F04B 45/027; F04B 35/045; F04B 39/0027; F04B 39/0033; F04B 43/0063

USPC ..... 417/312, 472, 473

See application file for complete search history.

(56) References Cited

U.S. PATENT DOCUMENTS

| | | | | |
|---|---|---|---|---|
| 4,072,210 | A * | 2/1978 | Chien | 184/5 |
| 5,567,127 | A * | 10/1996 | Wentz | 417/312 |
| 2007/0217929 | A1* | 9/2007 | Chiou | 417/412 |

* cited by examiner

*Primary Examiner* — Charles Freay
*Assistant Examiner* — Philip Stimpert

(57) ABSTRACT

A supplemental air pressure providing device adapted for use with an inflatable object includes an oscillator responsible for generating magnetic field and vibrating a casing, an air compressing device responsible for compressing air and noise silencer mounted inside the air compressing device for reducing noise generated while compressed air flows through the air compressing device for inflating the inflatable object.

10 Claims, 4 Drawing Sheets

SUPPLEMENTAL AIR PRESSURE PROVIDING DEVICE ADAPTED FOR USE WITH AN INFLATING MODULE FOR INFLATING AN INFLATABLE OBJECT

BACKGROUND OF THE INVENTION

1. Field of the Invention

The present invention relates to a supplemental air pressure providing device, and more particularly, to an air pressure providing device for an inflatable object such that when air pressure of the inflatable object is below a predetermined level, the air pressure providing device is able to provide supplemental air pressure to the inflatable object to maintain the air pressure of the object.

2. Description of the Prior Art

Inflatable objects have been extensively used in all kinds of applications, e.g. in hospitals for patients, outdoors for recreations and indoors for comfort. No matter what application and in what site the inflatable object is used, one thing in common for all users is that all the inflatable objects leak eventually, which causes uncomfortable for the users. To avoid such a situation, the user will have to constantly check the air pressure of the inflatable objects to make sure the inflatable objects provide the required comfort.

While there is a leak in the inflatable object, the user turns on the air pump to increase the air pressure inside the inflatable object and when the air pressure reaches the required level, the user turns off the air pump. This routine may be readily done during the daytime for the illumination is enough to do whatever is necessary. However, during the nighttime, especially when the user is asleep, not only the illumination is seriously insufficient, the user's willingness to undergo a troubleshooting process for the leak is also extremely low.

To avoid the inconvenience caused by the leak of the inflatable object, the best policy is that the air pressure of the inflatable object is maintained the entire time when the inflatable object is in use. And to maintain the air pressure of the inflatable object, the best option is to use another air pump to provide additional air pressure to the inflatable object in time when the air pressure of the inflatable object is decreasing. However, the operation of the air pump normally generates a great deal of noise and the vibration thereof causes uncomfortable to the user lying on top of the inflatable object.

As a result of the above, it is an objective of the present invention to provide a supplemental air pressure providing device to not only inflate the inflatable object, but also have features to minimize un-comfort caused by the noise and vibration by the operation of the device.

SUMMARY OF THE INVENTION

The primary objective of the present invention is to provide a supplemental air pressure providing device to provide supplemental air pressure to an inflatable object when the air pressure of the inflatable object is not within a reasonable level.

Another objective of the present invention is to provide a supplemental air pressure providing device which is able to minimize the noise caused by its operation.

In order to accomplish the aforementioned objectives, the supplemental air pressure providing device of the present invention includes an outer housing, an inner housing, a cushion securely mounted between the inner housing and the outer housing to reduce the vibration between the outer housing and the inner housing, an oscillator selectively activated, a bellow engaged with and moved by the oscillator to generate compressed air into a chamber where noise silencer is mounted to absorb noise caused by air flow through the chamber and check valves mounted inside the chamber to prevent reverse air flow.

Another objective of the present invention is that the noise silencer is a cotton silencer which is able to absorb air flow noise so as to reduce the noise caused by the device of the present invention.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
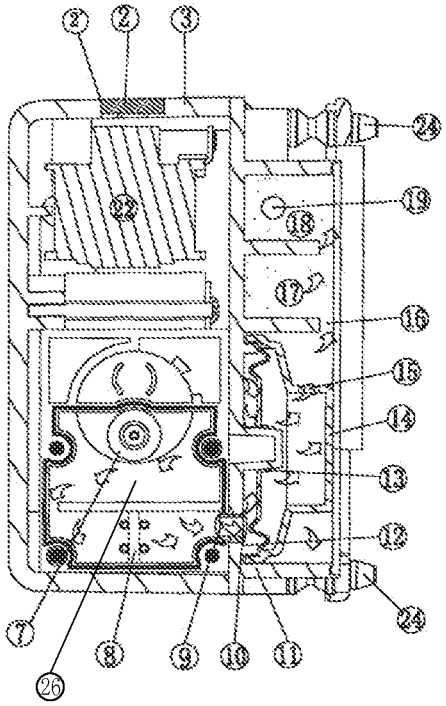
FIG. 1 is a schematic view showing the structure of the supplemental air pressure providing device of the present invention.
Figure 2:
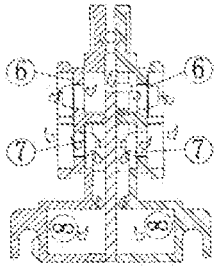
FIG. 2 is a cross sectional view of the chamber of the present invention.
Figure 3:
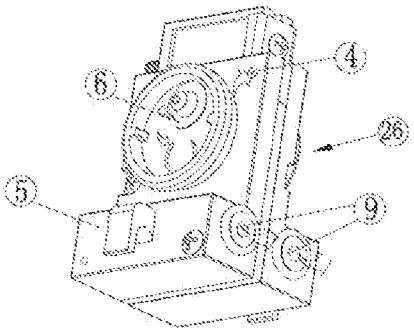
FIG. 3 is a perspective view showing the chamber of the present invention.

With reference to FIGS. 1~6, a supplemental air pressure providing device constructed in accordance with the present invention is adapted for use with an inflatable object 25 and includes an outer housing 23 having a first inlet 1 for ambient air to flow into the outer housing 23, an inner housing 3 with a second inlet 2', a first nozzle 21, and a chamber 26.

Figure 7:
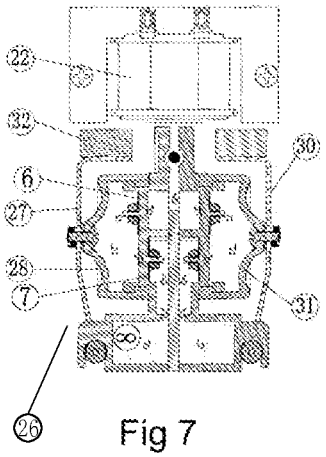
FIG. 7 is a schematic view showing the internal structure of the chamber of the present invention.

With reference to not only the above mentioned drawings, illustration from FIG. 7 is also incorporated. It is learned that the chamber 26 is composed of a casing 5 with a third inlet 4 and an outlet 9. An oscillator 22 is mounted next to the chamber 26 and a bellow device 30 is provided inside the chamber 26. The oscillator 22 is able to generate magnetic field, which in turn will oscillate magnets 32 mounted on a metal casing 27. The oscillation of the magnet 32 consequently drives the bellow device 30 to move. The bellow device 30 is composed of the metal casing 27 and a rubber cap 28 which is securely engaged with the metal casing 27. Due to the engagement relationship between the metal casing 27 and the rubber cap 28, the oscillation from the oscillator 22 will then drive the rubber cap 28 to move linearly. Inside the rubber cap 28, at least one check valve, two in this embodiment, namely a first check valve 6 and a second check valve 7 respectively, is mounted to regulate air flow direction. Additionally, a cotton silencer 8 is mounted inside the chamber 26 to reduce noise caused by air flow.

Figure 8:
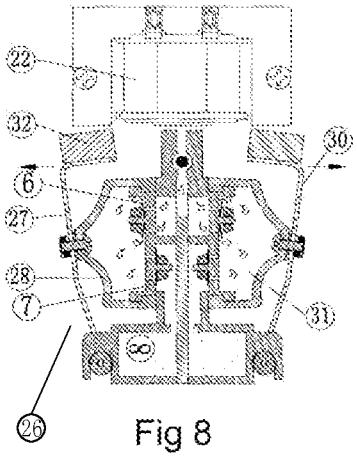
FIG. 8 is a schematic view showing the operation of the chamber of the present invention.
Figure 9:
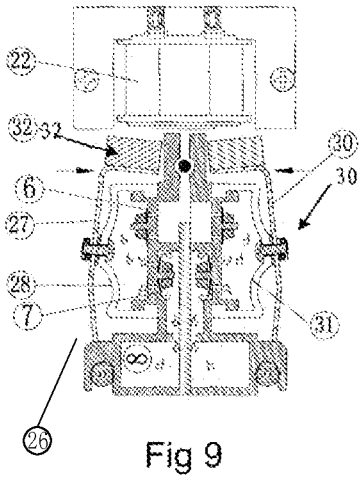
FIG. 9 is a schematic view showing another operation state of the chamber of the present invention.

With reference to FIGS. 8 and 9, it is noted that when the oscillator 22 is activated to generate magnetic field, the magnetic field will drive the magnets 32 on one end of the metal casing 27 to oscillate and consequently the metal casing 27 is moved accordingly. Air flows from the first check valve 6 and enters a space 31 inside the rubber cap 28 where the air is compressed due to the movement of the metal casing 27. Then the air flows to the second check valve 7 from the space 31. Additionally, the air flows through the cotton silencer 8, the outlet 9 and out of the chamber 26.

Figure 4:
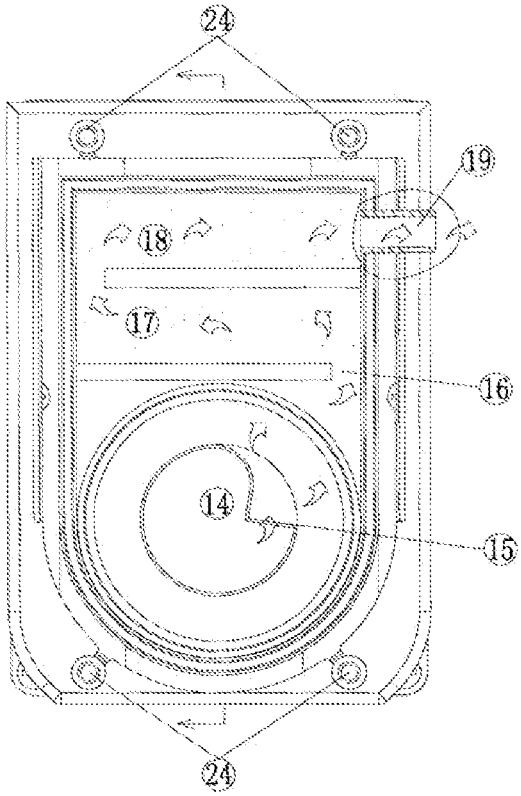
FIG. 4 is a schematic view showing the noise silence room of the present invention.
Figure 5:
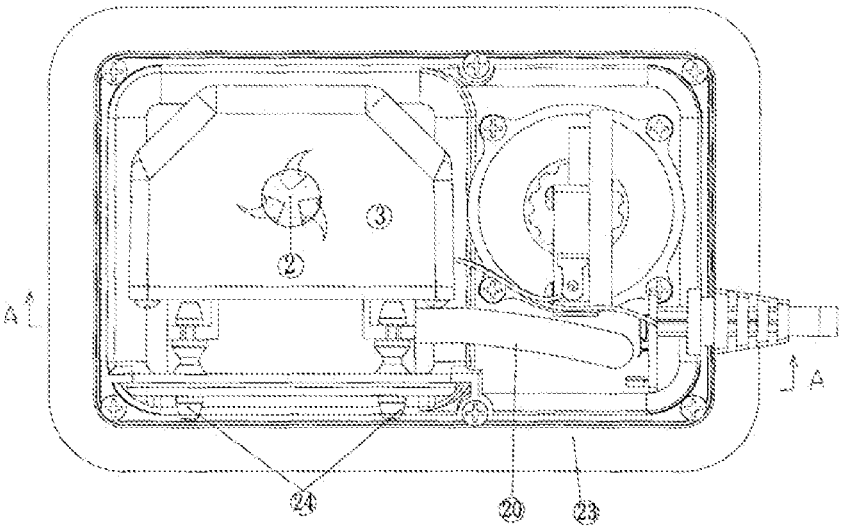
FIG. 5 is a top view showing the supplemental air pressure providing device of the present invention.
Figure 6:
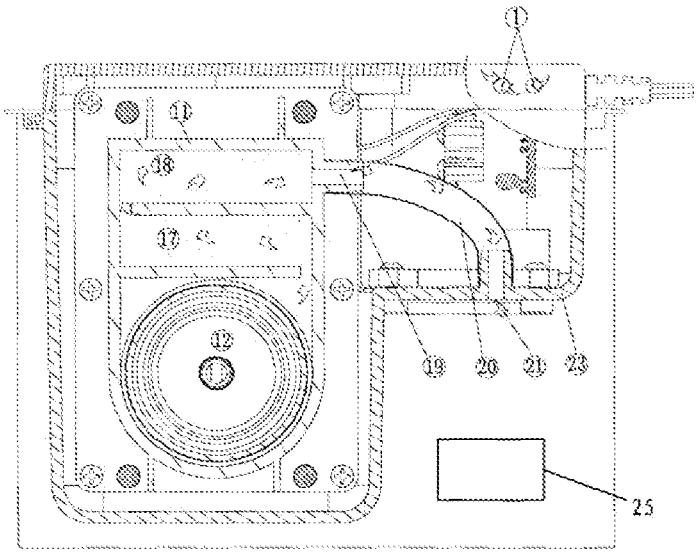
FIG. 6 is a cross sectional view taken from line A-A of FIG. 5.

As shown in FIG. 4, a noise silencing room 11 is defined inside the inner housing 3 and has an inlet 10 and a second nozzle 19 defined in an outer periphery of the noise silencing room 11. An air duct 20 is provided between the second nozzle 19 and the first nozzle 21. Besides, a valve 12 and noise absorbent 17, 18, made by such as cotton, are also provided inside the noise silencing room 11. The valve 12 is provided with an inlet 13 and a unidirectional cap 14 mounted outside the valve 12 and having an outlet 15. Furthermore, cotton silencers 2 may also be provided in the second inlet 2' and/or the first nozzle 21.

A cushion 24 made by such as rubber is provided between the noise silencing room 11 of the inner housing 3 and the outer housing 23 to greatly reduce noise caused by vibration.

From the structure and arrangement of all the components set forth above, it is noted that air flows from the first inlet 1 of the outer housing 23 and passes through the second inlet 2', the cotton silencers 2 and reaches inner housing 3. Then the air continues to flow through the third inlet 4 and enters the casing 5. Before the air is compressed in the space 31, the air passes the first check valve 6. Then the air flows out from the second check valve 7 while passing through the cotton silencer 8 and the outlet 9. Again, the air flows into the noise silencing room 11 from the inlet 10 and passes through the valve 12 from the inlet 13. From the structure of the valve 12 as well as the noise silencing room 11, gap is generated when the air is flowing upward to allow the air to flow therethrough. However, if the air is flowing downward, due to the strength of the air flow is not able to push away the valve 12, there is no gap generated such that the air is prevented from flowing reversely.

From the valve 12, the air flows into the unidirectional cap 14 and from the outlet 15, a space 16, the air reaches the noise absorbent 17, 18 to reduce the noise so generated. And from the second nozzle 19, the air flows out of the noise silencing room 11 and from the air duct 20, the air flows to the inflatable object from the first nozzle 21.

It is to be noted that although the preferred embodiment of the present invention has been described, other modifications, alterations or minor change to the structure should still be within the scope defined in the claims. As those skilled in the art will readily observe that numerous modifications and alterations of the device and method may be made while retaining the teachings of the invention.

What is claimed is:

1. A supplemental air pressure providing device adapted for use with an inflatable object, the supplemental air pressure providing device comprising:

an outer housing having a first inlet for receiving ambient air;

an inner housing located inside the outer housing and comprising:

a second inlet for receiving air via the first inlet;

means for compressing air comprising a chamber having an inlet valve and an outlet valve; and a noise silencing room;

a cushion provided between the inner housing and the outer housing for minimizing vibration between the inner housing and the outer housing;

a discharge valve with a third inlet communicating between the chamber and the noise silencing room, wherein the valve allows air to flow from the chamber to the noise silencing room, but prevents air from flowing from the noise silencing room to the chamber.

2. The supplemental air pressure providing device as claimed in claim 1, wherein the chamber comprises a casing, and wherein the means for compressing air further includes:

magnets securely mounted on one end of the casing;

an oscillator generating magnetic field to drive the magnets to vibrate such that the casing is also vibrated;

a cap securely engaged with the casing so as to move with the casing when the magnets are influenced by the magnetic field; and check valves provided inside the cap to prevent air from reverse movement.

3. The supplemental air pressure providing device as claimed in claim 2, wherein a silencer is mounted inside the chamber for reducing noise generated from air flow.

4. The supplemental air pressure providing device as claimed in claim 2, wherein the cushion is provided between the outer housing and the noise silencing room.

5. The supplemental air pressure providing device as claimed in 3, wherein the silencer is made of cotton for reducing noise.

6. The supplemental air pressure providing device as claimed in 4, wherein the noise silencing room has therein absorbent to absorb noise.

7. The supplemental air pressure providing device as claimed in claim 1, further comprising a noise silencer mounted inside the air compressing means for reducing noise generated while compressed air flows through the air compressing means for inflating the inflatable object.

8. The supplemental air pressure providing device as claimed in claim 1, wherein the means for compressing air is configured to activate when pressure is below a predetermined level so as to maintain air pressure in the inflatable object.

9. The supplemental air pressure providing device as claimed in claim 1, wherein structures of the valve and the noise silencing room are configured such that a gap is generated when the air is flowing from the chamber to the noise silencing room, and the gap is closed when air is flowing from the noise silencing room to the chamber.

10. The supplemental air pressure providing device as claimed in claim 1, further comprising a unidirectional cap mounted outside the valve and having an outlet communicating with an interior of the inflatable body.

* * * * *